US009677826B2

(12) United States Patent
Hu et al.

(10) Patent No.: US 9,677,826 B2
(45) Date of Patent: Jun. 13, 2017

(54) COMBO-COOLER

(71) Applicant: Valeo, Inc., Auburn Hills, MI (US)

(72) Inventors: Zaiqian Hu, Rochester Hills, MI (US); Ricardo Sanchez Garcia, San Luis Potosi (MX); Ian Kobisher Cordova, San Luis Potosi (MX)

(73) Assignee: Valeo, Inc., Auburn Hills, MI (US)

( * ) Notice: Subject to any disclaimer, the term of this patent is extended or adjusted under 35 U.S.C. 154(b) by 541 days.

(21) Appl. No.: 14/137,748

(22) Filed: Dec. 20, 2013

(65) Prior Publication Data

US 2015/0176924 A1 Jun. 25, 2015

(51) Int. Cl.

| | |
|---|---|
| ***F28F 9/013*** | (2006.01) |
| ***F28F 9/00*** | (2006.01) |
| ***F28F 9/02*** | (2006.01) |
| ***F28D 1/04*** | (2006.01) |
| ***F28D 1/053*** | (2006.01) |

(Continued)

(52) U.S. Cl.

CPC ..... *F28F 9/013* (2013.01); *F28D 1/0408* (2013.01); *F28D 1/0426* (2013.01); *F28D 1/05333* (2013.01); *F28D 7/0066* (2013.01); *F28F 9/002* (2013.01); *F28F 9/0212* (2013.01); *F28F 9/0231* (2013.01); *F28D 2021/0084* (2013.01); *F28F 2265/26* (2013.01); *F28F 2275/085* (2013.01)

(58) Field of Classification Search

CPC ..... F28F 2009/0295; F28F 2009/0287; F28F 9/06; F28F 9/0207; F28F 9/002; F28F 9/0212; F28F 9/013; F28F 9/0231; F28F 2265/26; F28F 2275/085; F28D 2021/0084; F28D 1/0443; F28D 7/0066; F28D 1/05333; F28D 1/0408; F28D 1/0426

USPC ..... 165/176

See application file for complete search history.

(56) References Cited

U.S. PATENT DOCUMENTS 5,325,915 A * 7/1994 Fouts ..... F28D 1/0325 165/144
7,284,594 B2 * 10/2007 Sanada ..... F28F 9/002 165/132

(Continued)

FOREIGN PATENT DOCUMENTS

JP 3399210 B2 * 4/2003 ..... F28D 1/0443
JP 2006226649 A * 8/2006

*Primary Examiner* — Tho V Duong
(74) *Attorney, Agent, or Firm* — Dierker & Kavanaugh, P.C.

(57) ABSTRACT

A combo-cooler includes heat exchangers having parallel tubes corresponding to each heat exchanger aligned in a tube plane. A first end tank assembly includes a columnar end tank separated by a baffle into compartments each in fluid communication with a respective hydraulically independent fluid circuit. The second tank assembly includes manifolds aligned in a column. Serially adjacent manifolds are in slidable contact or separated by a respective gap to allow relative translation. Banks of the tubes are brazed in fluid communication with a compartment and a manifold to connect the compartment and the manifold to have a respective fluid flow therethrough. A bracket contacts at least two of the serially adjacent manifolds to prevent translation between the bracket and the serially adjacent manifolds perpendicular to the tube plane and to allow relative translation between the at least two of the serially adjacent manifolds parallel to the tubes.

14 Claims, 6 Drawing Sheets

(51) Int. Cl.
*F28D 7/00* (2006.01)
*F28D 21/00* (2006.01)

(56) References Cited

U.S. PATENT DOCUMENTS

| | | | | |
|---|---|---|---|---|
| 7,506,683 | B2 | 3/2009 | Hu | |
| 7,523,782 | B2 | 4/2009 | Lorentz et al. | |
| 7,527,087 | B2 | 5/2009 | Desai et al. | |
| 8,061,410 | B2 * | 11/2011 | Machanek | F28D 1/0443 165/140 |
| 8,534,346 | B1 * | 9/2013 | Mecozzi | F28F 9/001 165/54 |
| 2005/0217831 | A1 * | 10/2005 | Manaka | F28D 1/0443 165/140 |
| 2008/0006390 | A1 * | 1/2008 | Nakayama | F28D 1/0443 165/76 |
| 2011/0240257 | A1 * | 10/2011 | Piggott | F28D 1/05366 165/67 |

* cited by examiner

COMBO-COOLER

BACKGROUND

It has become desirable, particularly in the automotive industry, to combine multiple heat exchangers into a single package. Combining heat exchangers into a single package may present challenges to efficient manufacturing and product reliability and quality. An advantage of multiple heat exchangers (multi-exchangers) or combo-coolers is that the heat exchangers can share the same frontal area or space of a vehicle. Multi-exchanger or combo cooler heat exchangers have two or more heat exchanger parts comprising fluid conduits or tubes wherein different fluids can flow within the different tubes.

BRIEF DESCRIPTION OF THE DRAWINGS

Features and advantages of examples of the present disclosure will become apparent by reference to the following detailed description and drawings, in which like reference numerals correspond to the same or similar, though perhaps not identical, components. For the sake of brevity, reference numerals or features having a previously described function may or may not be described in connection with other drawings in which they appear.

DETAILED DESCRIPTION

Combo-coolers of various types are used in automotive applications. For example, a combo-cooler is disclosed in U.S. Pat. No. 6,394,176. In one form of combo-cooler, two or more heat exchangers have been put together between two end tank assemblies. The sharing of the end tank assemblies and attachment brackets has contributed significant savings in packaging space and in raw material. However, thermal stress at adjacent heat exchangers may potentially lead to reliability concerns in some existing combo-coolers. Different fluids in different heat exchangers may have respective different operating temperatures. Thermal expansion and contraction may be quite different between adjacent heat exchangers. The shared tanks/manifolds in some existing combo-coolers are structurally strong and stiff. When a tube from one heat exchanger expands from an increase in temperature, the stiff tank/manifold may exert significant thermal stress on the tubes of an adjacent heat exchanger that may be operating at a lower temperature.

To reduce such thermal stress while preserving the cost savings in terms of packaging and raw material (from sharing a pair of tanks/manifolds), combo-coolers of the present disclosure include a weakened tank/manifold assembly at the interface between adjacent heat exchangers in the combo-cooler. Cutting the tank/manifold into separate tanks/manifolds may reduce or entirely remove the thermal stress from adjacent heat exchangers. However, cutting the tank/manifold may also weaken the structure of the combo-cooler, leaving only the fins to structurally link adjacent heat exchangers. Such a combo-cooler may experience vibration in the fore/aft direction in a vehicle coordinate system (perpendicular to the core surface of combo-cooler). Examples of the present disclosure may improve the reliability of the combo-cooler in a vibration environment that may be experienced in an automobile.

In examples of the present disclosure, there is clearance between the cut tank/manifold and the bracket in the tube length direction (thermal expansion/contraction direction). As such, the adjacent heat exchangers can freely expand/contract without generating thermal stress between the adjacent heat exchangers. However, in the core depth direction (perpendicular to tube length direction), fore/aft direction movement of the tank/manifold is limited by the bracket, increasing the structural integrity in the core depth direction.

Figure 1:
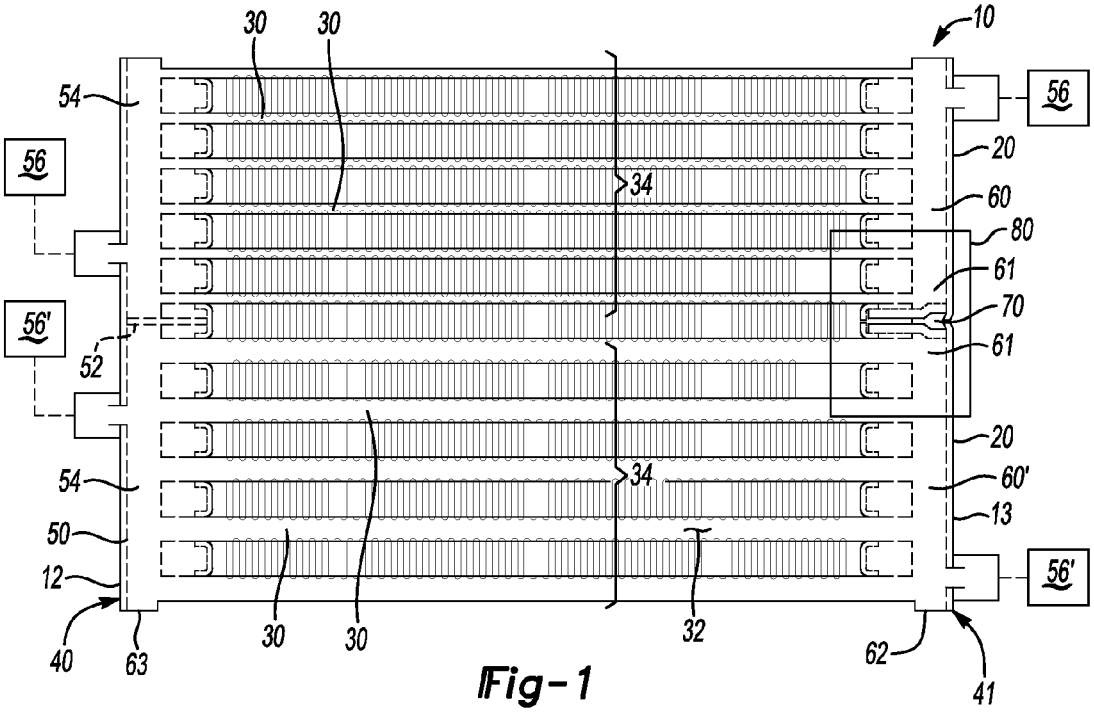
FIG. 1 is a semi-schematic rear view of an example of a combo-cooler according to the present disclosure.

FIG. 1 is a semi-schematic rear view of an example of a combo-cooler 10 according to the present disclosure. The combo-cooler 10 includes a plurality of heat exchangers 20 having parallel tubes 30 corresponding to each heat exchanger 20 aligned in a tube plane 32. As used herein, "tube plane" means an infinite plane, and therefore reaches beyond the extent of tubes 30 aligned in the tube plane 32. The combo-cooler 10 has a first end tank assembly 40 disposed at a first end 12 of the combo-cooler 10. The first end tank assembly 40 includes a columnar end tank 50 separated by at least one baffle 52 into a plurality of compartments 54 wherein each compartment 54 is in fluid communication with a respective hydraulically independent fluid circuit 56, 56'. A second end tank assembly 41 is disposed at a second end 13 of the combo-cooler 10 opposite the first end 12. The second end tank assembly 41 includes a plurality of manifolds 60, 60' substantially aligned in a column 62 parallel to the first end tank assembly 40. Serially adjacent manifolds 61 in the plurality of manifolds 60, 60' are in slidable contact or separated by a respective gap 70 to allow relative translation between the serially adjacent manifolds 61. A plurality of banks 34 of the parallel tubes 30 is brazed in fluid communication with a respective compartment 54 of the first end tank assembly 40 and a respective manifold 60, 60' of the second end tank assembly 41 to connect the respective compartment 54 and the respective manifold 60, 60' on the respective hydraulically independent fluid circuit 56, 56' to have a respective fluid flow therethrough. A bracket 80 is in contact with at least two of the serially adjacent manifolds 61 to prevent relative translation between the bracket 80 and the at least two of the serially adjacent manifolds 61 perpendicular to the tube plane 32 and to allow relative translation between the at least two of the serially adjacent manifolds 61 parallel to the tubes 30.

Figure 2:
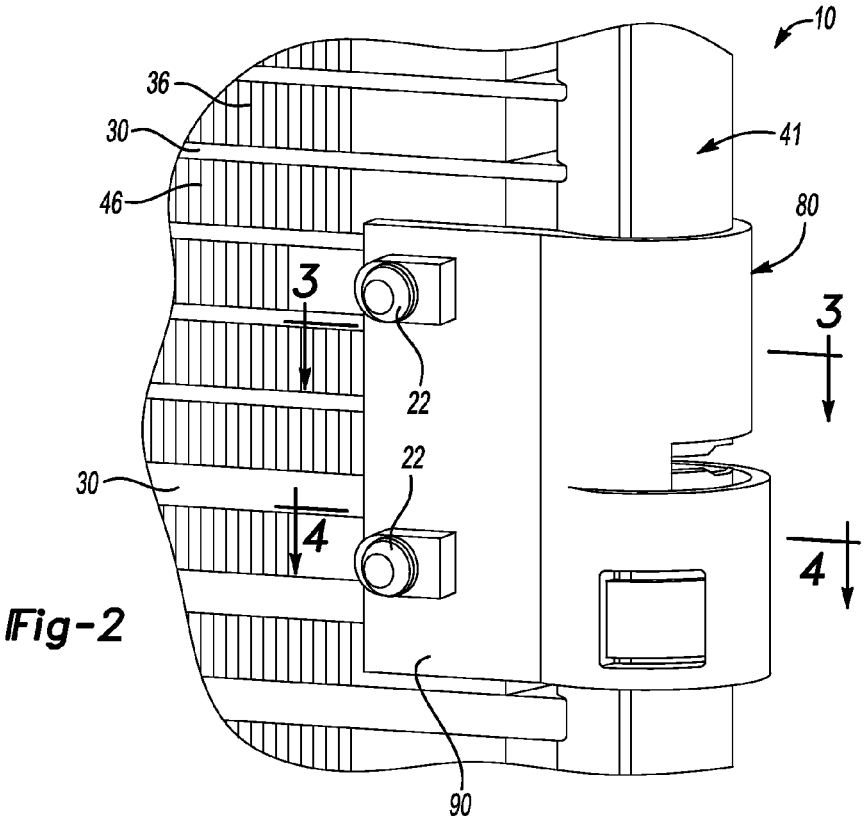
FIG. 2 is a semi-schematic rear perspective view of an example of a bracket mounted to a combo-cooler according to the present disclosure.

FIG. 2 is a semi-schematic rear perspective view of an example of a bracket mounted to a combo-cooler 10 according to the present disclosure. The bracket 80 may be made from plastic, metal, or combinations of plastic and metal. A fastener 22 may connect a first leg 90 of the bracket 80 to a second leg 91 (see FIG. 3) of the bracket 80 through the core 36 of the combo-cooler 10. As used herein, the core 36 of the combo-cooler 10 is the portion of the combo-cooler having the tubes 30 and the fins 46.

Figure 3:
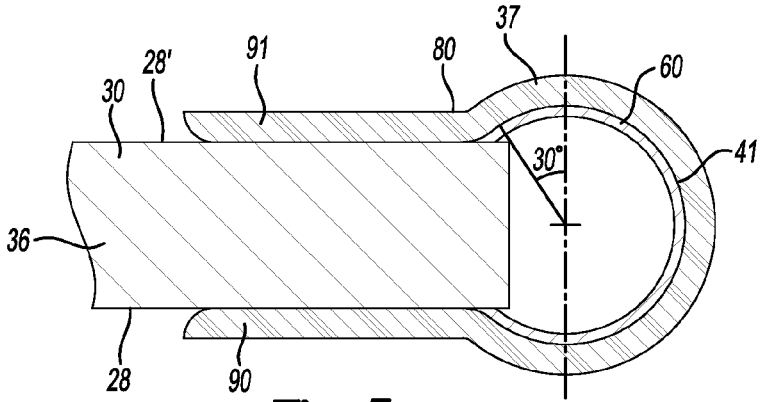
FIG. 3 is a semi-schematic top cross-sectional view through the bracket and tank of the combo-cooler depicted in FIG. 2.
Figure 4:
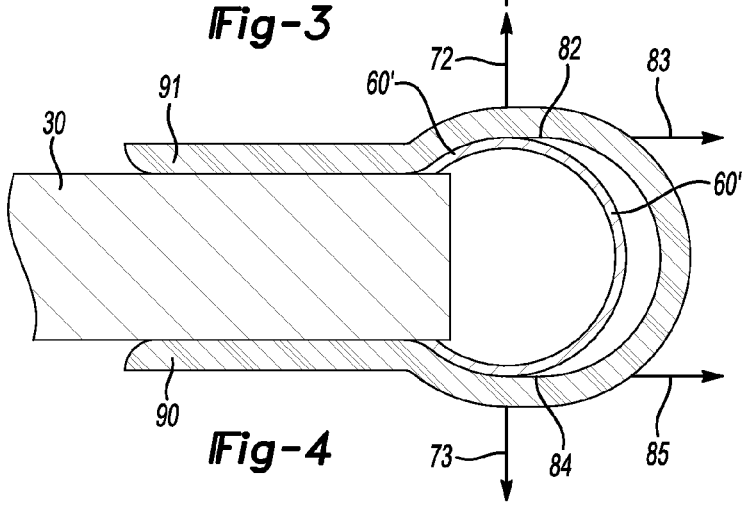
FIG. 4 is another semi-schematic top cross-sectional view through the bracket and tank of the combo-cooler depicted in FIG. 2.

As depicted in FIGS. 2, 3 and 4, the bracket 80 may include a first leg 90 projecting from a manifold-contacting portion 37 of the bracket 80. The bracket 80 may also include a second leg 91 opposite the first leg 90, projecting from the manifold-contacting portion 37 of the bracket 80. The first leg 90 and the second leg 91 are each parallel to the tube plane 32 (see FIGS. 1 and 5). The first leg 90 and the second leg 91 contact the core 36 of the combo-cooler 10 on opposed faces 28, 28' of the core 36 of the combo cooler 10. In examples of the present disclosure, the bracket 80 may be formed without legs 90, 91.

FIG. 3 is a semi-schematic top cross-sectional view through the bracket and second end tank assembly 41 of the combo-cooler depicted in FIG. 2. The bracket 80 is resilient. During assembly of examples of the combo-cooler 10 of the present disclosure, the bracket 80 may snap onto the second end tank assembly 41 and tend to remain in the same position while on an assembly line (not shown) without fasteners or adhesives. The snap-on characteristic is provided by wrapping more than 180 degrees around the manifold 60. However, the amount that the bracket 80 has to be spread open to install over the second end tank assembly 41 is reduced by not wrapping the bracket 80 much more than about 30 degrees beyond 180 degrees on each side of the second end tank assembly 41. FIG. 3 depicts a cross-section through a portion of the bracket 80 that does not allow relative translation between the bracket 80 and the manifold 60 attached to the bracket 80. However, since the bracket 80 does allow relative translation in the section around the lower manifold 60' shown in FIG. 2 and FIG. 4, relative translation between the at least two of the serially adjacent manifolds 61 parallel to the tubes 30 is allowed. Although the bracket 80 may snap onto the manifold 60, 60', the clamping force of the bracket 80 on the manifold 60, 60' does not prevent the relative translation between the at least two of the serially adjacent manifolds 61 parallel to the tubes 30 as described above relative to FIG. 1.

FIG. 4 is another semi-schematic top cross-sectional view through the bracket 80 and second end tank assembly 41 of the combo-cooler 10 depicted in FIG. 2. The cross-section depicted in FIG. 4 is similar to the cross section depicted in FIG. 3 except the depicted cross-section of the bracket 80 depicted in FIG. 4 includes a first planar support surface 82 having a first line of translation 83 defined thereon. The first line of translation 83 is parallel to the plurality of parallel tubes 30 (see FIG. 1). The first planar support surface 82 is in slidable contact with a respective manifold 60' to prevent relative motion between the bracket 80 and the respective manifold 60' in a first direction 72 normal to the tube plane 32. The bracket 80 further includes a second planar support surface 84. The second planar support surface 84 is opposite the first planar support surface 82. The second planar support surface 84 has a second line of translation 85 defined thereon. The second line of translation 85 is parallel to the parallel tubes 30. The second planar support surface 84 is in slidable contact with the respective manifold 60' to prevent relative motion between the bracket 80 and the respective manifold 60' in a second direction 73 normal to the tube plane 32 and opposite to the first direction 72.

In examples of the present disclosure, the amount of thermal expansion and contraction of the tubes ranges from about 2 mm to about 7 mm. As such, the first planar support surface 82 and the second planar support surface 84 are sized to allow the thermal expansion and contraction of the tubes 30.

Figure 5:
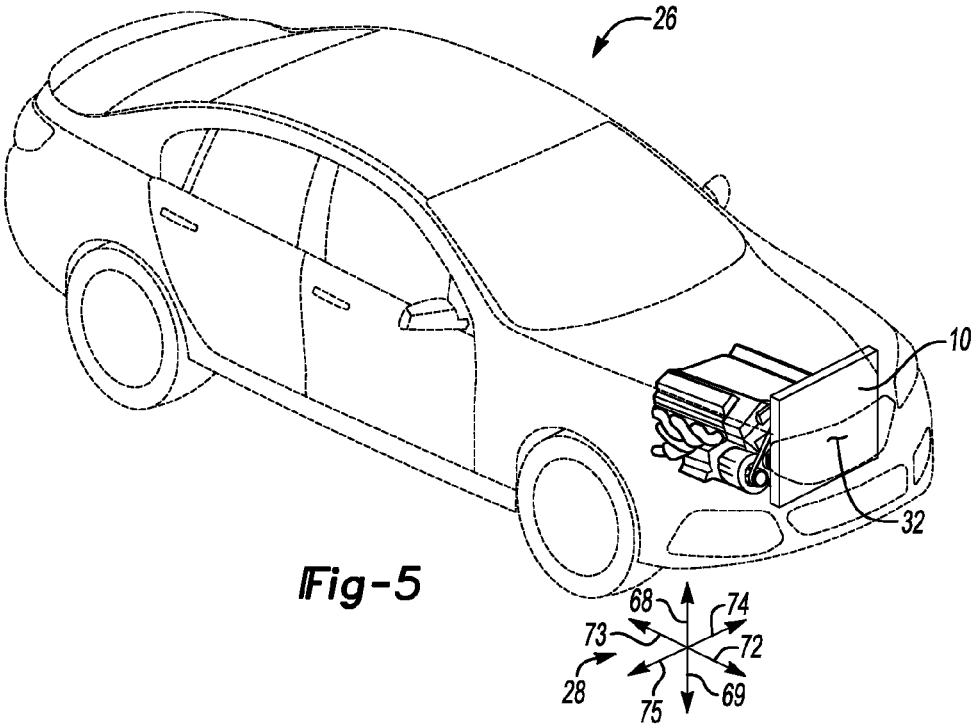
FIG. 5 is a semi-schematic perspective view of a vehicle with a combo-cooler according to the present disclosure mounted thereon.

FIG. 5 is a semi-schematic perspective view of a vehicle 26 with a combo-cooler 10 according to the present disclosure mounted thereon. A vehicle Cartesian coordinate system 28 is depicted: the vehicle forward direction is at 72; vehicle aft is at 73; left is at 74; right is at 75; vehicle up is at 68; and down is at 69. The combo-cooler 10 is depicted in the tube plane 32 parallel to the up 68-right 75 coordinate plane.

Figure 6:
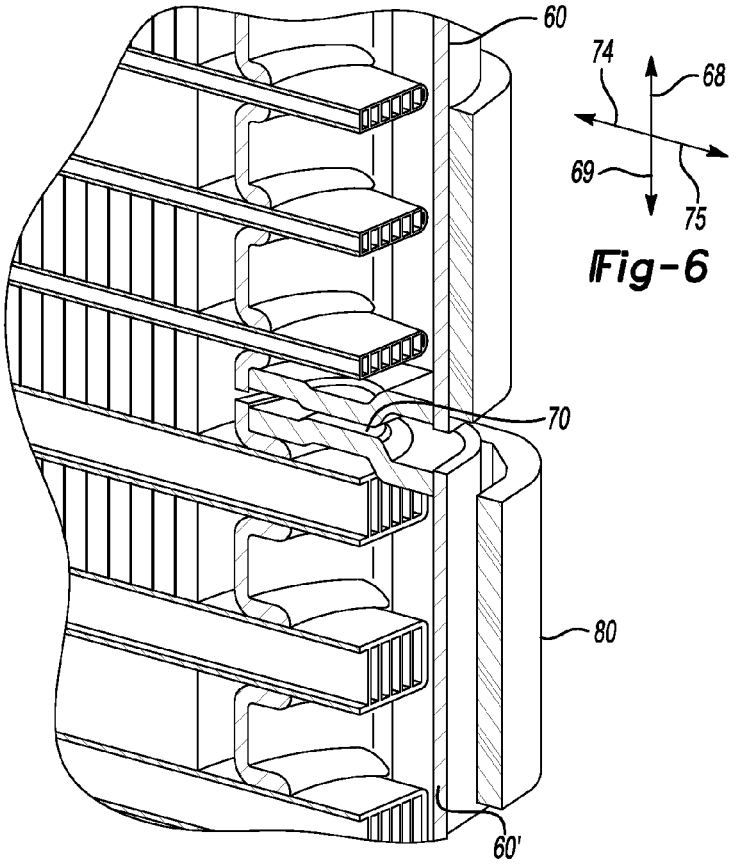
FIG. 6 is a cutaway perspective view of a bracket mounted on a combo-cooler according to the present disclosure.

FIG. 6 is a cutaway perspective view of a bracket mounted on a combo-cooler according to the present disclosure. FIG. 6 has a good view of the gap 70 between the upper manifold 60 and the lower manifold 60' in FIG. 6. It is to be understood that "upper" and "lower" are used with reference to FIG. 6 to depict the relative orientation of the manifolds 60, 60' in FIG. 6. In this particular instance, "upper" and "lower" are not meant to convey a limitation. In FIG. 6, the portion of the bracket 80 shown adjacent to manifold 60' has a space 48 that allows the manifold to move in the vehicle left 74-right 75 directions. The portion of the bracket 80 shown adjacent to manifold 60 is depicted in contact with the manifold 60 to prevent relative movement between the bracket 80 and the manifold 60 in the vehicle left 74-right 75 directions.

Figure 7:
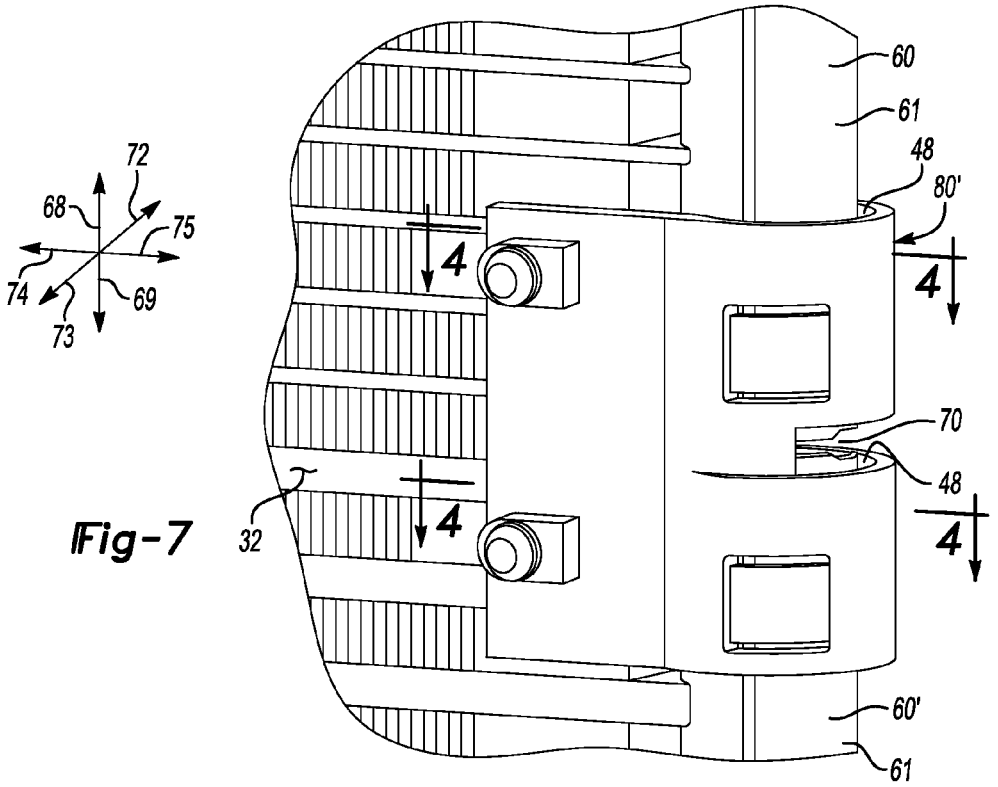
FIG. 7 is a semi-schematic rear perspective view of another example of a bracket mounted to a combo-cooler according to the present disclosure.

FIG. 7 a semi-schematic rear perspective view of another example of a bracket 80' mounted to a combo-cooler 10 according to the present disclosure. The bracket 80' shown in FIG. 7 is similar to the bracket 80 shown in FIG. 2 except both the upper and lower portions of the bracket 80' have the space 48 that allows relative motion between the manifolds 60, 60' and the bracket 80' in the vehicle left 74-right 75 directions. It is to be understood that the vehicle directions are provided as a convention to coordinate the description herein with the Figs. In FIG. 7, the bracket 80' may be made from plastic, metal, or combinations of plastic and metal. The bracket 80' includes a plurality of first planar support surfaces 82 (see FIG. 4) each having a respective first line of translation 83 defined thereon. Note that the cross-sections through the upper and lower portions of FIG. 7 both refer to FIG. 4. It is to be understood that although only the reference numeral 60' is depicted in FIG. 4, the cross section of the upper manifold 60 is substantially similar to the cross section of the lower manifold 60', therefore both 60 and 60' are depicted in FIG. 4, when read together with FIG. 7. Each respective first line of translation 83 is parallel to the plurality of parallel tubes 30. Each of the first planar support surfaces 82 is in slidable contact with a respective manifold 60, 60' to prevent relative motion between the bracket 80' and the respective manifold 60, 60' in a first direction 72 normal to the tube plane 32. The bracket 80' further includes a plurality of second planar support surfaces 84. Each of the second planar support surfaces 84 is opposite a respective first planar support surface 82. Each second planar support surface 84 has a respective second line of translation 85 defined thereon. Each respective second line of translation 85 is parallel to the parallel tubes 30. Each second planar support surface 84 is in slidable contact with a corresponding manifold 60, 60' to prevent relative motion between the bracket 80 and the corresponding manifold 60, 60' in a second direction 73 normal to the tube plane 32 and opposite to the first direction 72.

Figure 8:
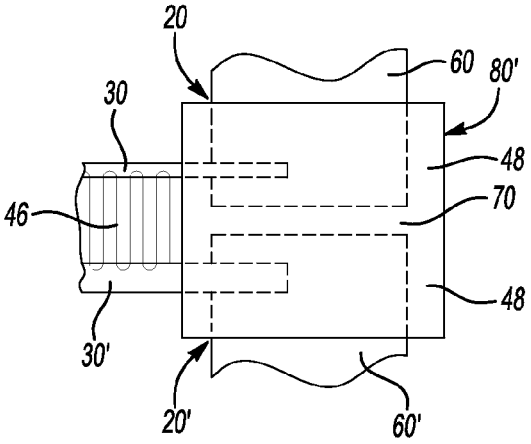
FIG. 8 is a semi-schematic rear view of an example of a bracket mounted on a combo-cooler of the present disclosure.

FIG. 8 is a semi-schematic rear view of an example of a bracket 80' mounted on a combo-cooler 10 of the present disclosure. In FIG. 8, the elements are depicted with geometrically simplified shapes. FIG. 8 depicts a bracket 80' similar to the bracket shown in FIG. 7. There is a space 48 shown between the bracket 80' and each of the manifolds 60, 60' shown in FIG. 8. The gap 70 between the manifolds 60, 60' shows that there is clearance between the manifolds 60, 60'. Without the bracket 80', the heat exchangers 20, 20' would be mainly joined by the fin 46 brazed between the heat exchanger 20 having the smaller tube 30 and the other heat exchanger 20' having the larger tube 30'.

Figure 9:
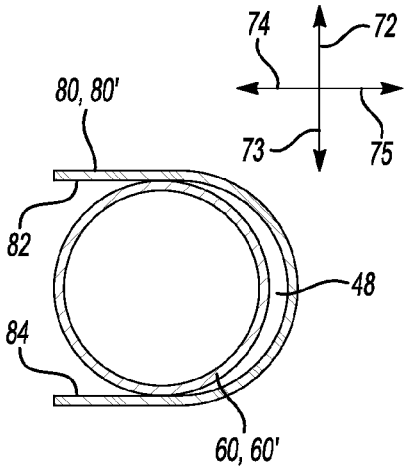
FIG. 9 is a semi-schematic top cross-section view of a bracket holding a tank according to the present disclosure.

FIG. 9 is a semi-schematic top cross-section view of a bracket 80, 80' holding a manifold 60, 60' according to the present disclosure. FIG. 9 exaggerates the length of the first planar support surface 82 and the second planar support surface 84 to more clearly show that relative motion is allowed in the 74-75 directions, but not in the 72-73 directions.

Figure 10A:
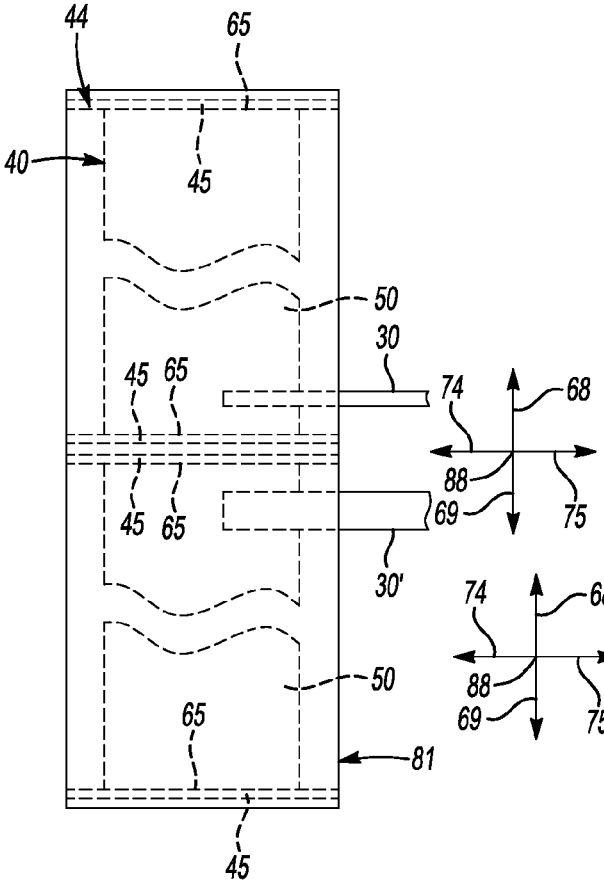
FIG. 10A is a semi-schematic rear view of a bracket mounted to a combo-cooler according to the present disclosure.

FIG. 10A is a semi-schematic rear view of another bracket 81 mounted to a combo-cooler 10 according to the present disclosure. In examples of the present disclosure, the other bracket 81 may include a plurality 44 of stop flanges 45 each stop flange 45 disposed in slidable contact with an end 65 of a respective columnar end tank 50 to prevent relative motion between the other bracket 81 and the respective columnar end tank 50 in the 68-69 directions, orthogonal to alien 89 defined parallel to the tubes 30, 30' and orthogonal to the first direction 72. The stop flanges depicted in FIG. 10A prevent the other bracket 81 from being displaced along the first end tank assembly 40 caused by vibration in the vehicle 26.

Figure 10B:
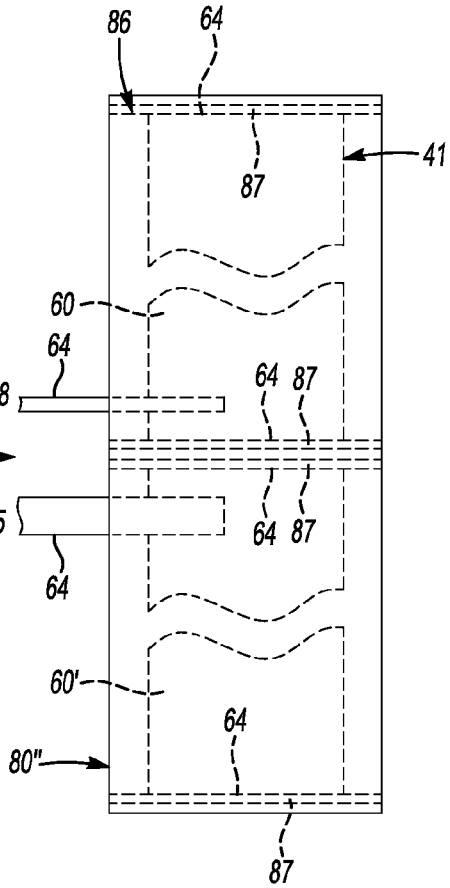
FIG. 10B is a semi-schematic rear view of another bracket mounted to a combo-cooler according to the present disclosure.
Figure 11A:
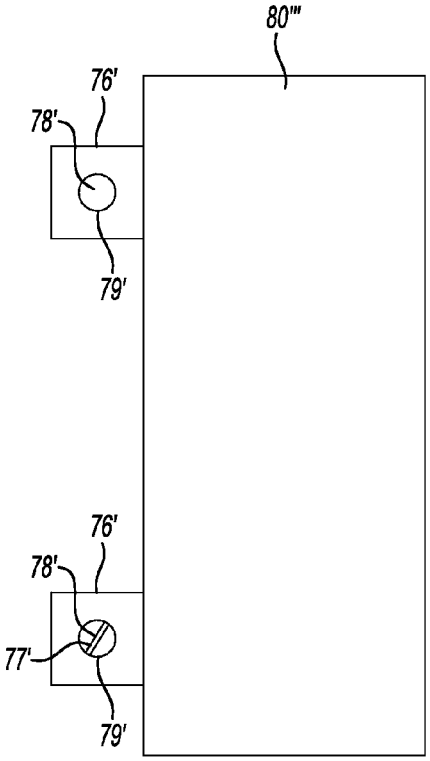
FIG. 11A is a semi-schematic rear view of a mounting bracket including a projection with a mounting point for attaching the combo-cooler to a vehicle according to the present disclosure.

FIG. 10B is a semi-schematic rear view of a bracket 80" mounted to a combo-cooler 10 according to the present disclosure. FIG. 10B is similar to FIG. 10A except the bracket 80" is mounted on the second end tank assembly 41. In examples of the present disclosure, the bracket 80" may include another plurality 86 of other stop flanges 87 each other stop flange 87 disposed in slidable contact with an end 64 of a respective manifold 60, 60' to prevent relative motion between the bracket 80" and the respective manifold 60, 60' in the 68-69 directions, orthogonal to another line 88 defined parallel to the tubes 30, 30' and orthogonal to the first direction 72. The stop flanges 87 depicted in FIG. 10B prevent the bracket 80" from being displaced along the second end tank assembly 41 caused by vibration in the vehicle 26. FIG. 11A is a semi-schematic rear view of a mounting bracket 80'" including a projection 76' with a mounting point 78' for attaching the combo-cooler 10 to a vehicle 26 (see FIG. 5) according to the present disclosure. The mounting point 78' may define a hole 79' for cooperation with a mounting fastener (not shown). The mounting fastener may be a screw, bolt, nut, speed nut, fir-tree, clip, or other device for attaching the combo-cooler 10 to the vehicle 26. The mounting point 78' may include an attached or integrated fastener shown schematically at 77'. Some examples of the attached or integrated fastener 77' include a peg or pin molded into the mounting point 78', a metal nut overmolded into the mounting point 78', a screw or bolt rotatably attached to the mounting point 78', and a quarter-turn fastener attached to the mounting point 78'.

Figure 11B:
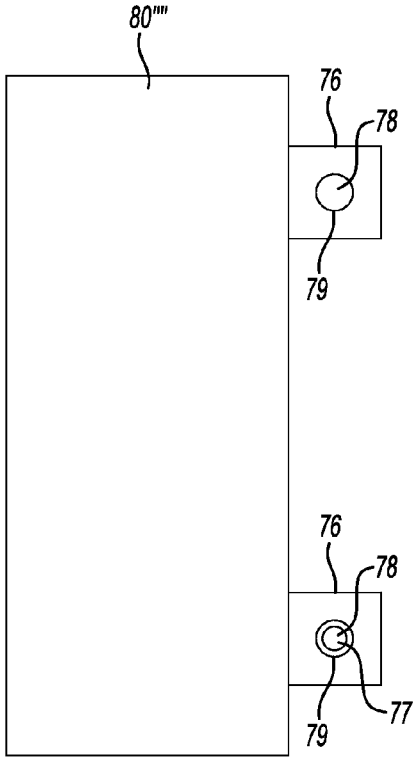
FIG. 11B is a semi-schematic rear view of another mounting bracket including a projection with a mounting point for attaching the combo-cooler to a vehicle according to the present disclosure.
Figure 12:
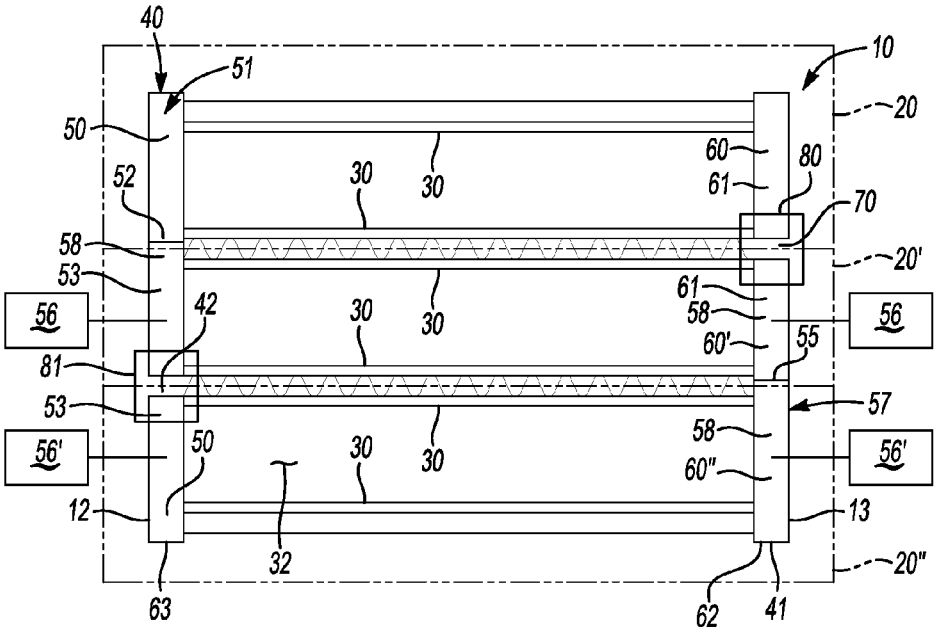
FIG. 12 is a semi-schematic rear view of an example of a combo-cooler according to the present disclosure.

FIG. 11B is a semi-schematic rear view of another mounting bracket 80"" including another projection 76 with another mounting point 78 for attaching the combo-cooler 10 to a vehicle 26 according to the present disclosure. FIG. 11B is similar to FIG. 11A except the other mounting bracket 80"" attaches the combo-cooler 10 to the vehicle 26 at the second end tank assembly 41, rather than the first end tank assembly 40. As depicted in FIG. 11B, the other mounting bracket 80"" may include another projection 76 with another mounting point 78 for attaching the combo-cooler 10 to a vehicle 26 (see FIG. 5). The other mounting point 78 may define an aperture 79 for cooperation with another mounting fastener (not shown). The other mounting fastener may be a screw, bolt, nut, speed nut, fir-tree, clip, or other device for attaching the combo-cooler 10 to the vehicle 26. The other mounting point 78 may include an attached or integrated other fastener shown schematically at 77. Some examples of the attached or integrated other fastener include a peg or pin molded into the other mounting point 78, a metal nut overmolded into the other mounting point 78, a screw or bolt rotatably attached to the other mounting point 78, and a quarter-turn fastener attached to the other mounting point 78. The attached or integrated other fastener 77 may be a separate instance of the attached or integrated fastener 77'. FIG. 12 is a semi-schematic rear view of an example of a combo-cooler 10 with brackets 81, 80 respectively on the first end 12 and the second end 13 of the combo-cooler 10. In the example depicted in FIG. 12, the combo-cooler 10 has 3 heat exchangers 20, 20', 20". The manifold 60 is a member of a plurality of manifolds 60, 60', 60" included in the second end tank assembly 41. The plurality of manifolds 60, 60', 60" is substantially aligned in a column 62. Serially adjacent manifolds 61 in the plurality of manifolds 60, 60', 60" are in slidable contact or separated by a respective gap 70 to allow relative translation between the serially adjacent manifolds 61. An end tank 50 of the first end tank assembly 40 is separated by at least one baffle 52 into a plurality 57 of compartments 54 wherein, each compartment 54 is in fluid communication with a respective hydraulically independent fluid circuit 56, 56'. A bracket 81 is in contact with at least two of the serially adjacent manifolds 61 to prevent relative translation between the bracket 80 and the at least two of the serially adjacent manifolds 61 perpendicular to the tube plane 32 and to allow relative translation between the at least two adjacent manifolds 61 parallel to the tubes 30.

As further depicted in FIG. 12, the columnar end tank 50 is a member of a plurality 51 of columnar end tanks 50 included in the first end tank assembly 40. The plurality 51 of columnar end tanks 50 are substantially aligned in another column 63. Serially adjacent end tanks 53 in the plurality 51 of columnar end tanks 50 are in slidable contact or separated by a respective tank gap 42 to allow relative translation between the serially adjacent end tanks 53. A manifold 60 of the second end tank assembly 41 is separated by at least one septum 55 into a plurality 57 of enclosed volumes 58 wherein, each enclosed volume 58 is in fluid communication with a respective hydraulically independent fluid circuit 56, 56'. Another bracket 81 is in contact with at least two of the serially adjacent end tanks 53 to prevent relative translation between the other bracket 81 and the at least two of the serially adjacent end tanks 53 perpendicular to the tube plane 32 and to allow relative translation between the at least two adjacent end tanks 53 parallel to the tubes 30. Similarly to the bracket 80, the other bracket 81 may be made from plastic, metal, or combinations of plastic and metal.

Figure 13:
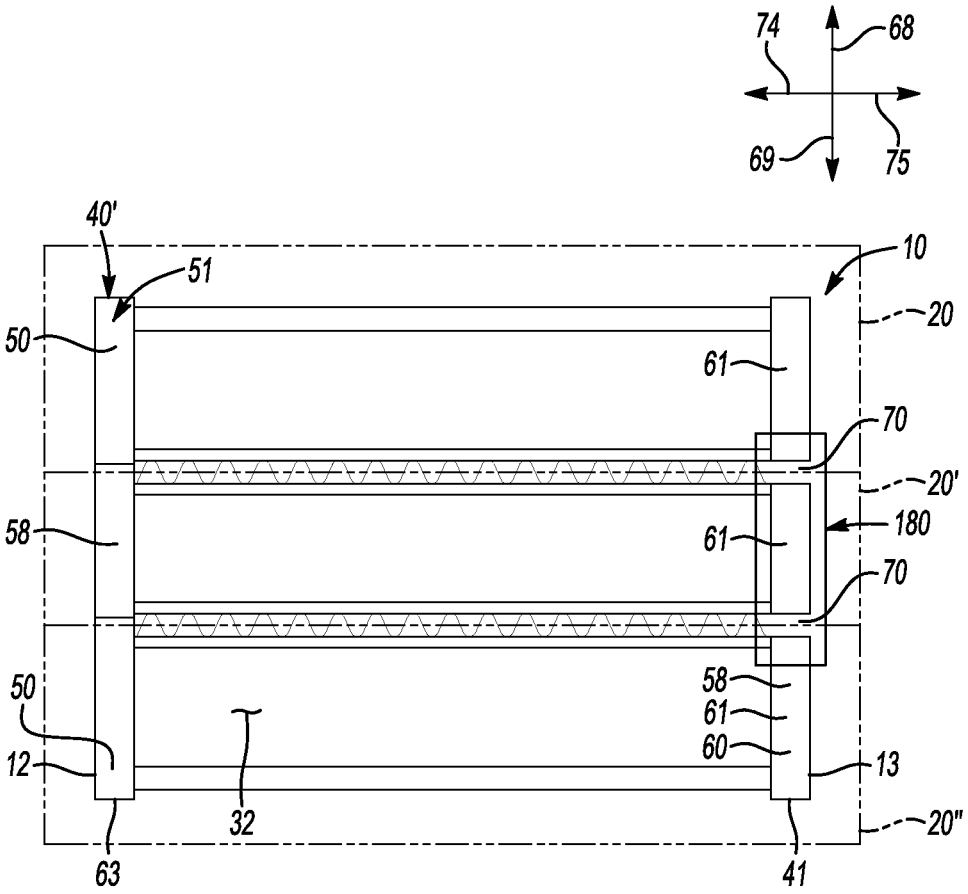
FIG. 13 is a semi-schematic rear view of an example of another combo-cooler according to the present disclosure.

In examples of the present disclosure, for packaging or other reasons, the fully cut sections may be on the same side of the core. In such examples, a single bracket may be included to hold the cut sections, as shown in FIG. 13. To illustrate, instead of two individual brackets holding the two manifold-cut sections, a single plastic bracket is used for hold both manifold cut sections: allowing the exchangers free expansion in the tube length direction, and removing/reducing the relative manifold movement in the vehicle fore-aft directions.

FIG. 13 is a semi-schematic rear view of an example of another combo-cooler 10 according to the present disclosure. The combo-cooler 10 depicted in FIG. 13 has second end tank assembly 41 with 2 gaps 70 that separate the second end tank assembly 41 into 3 serially adjacent manifolds 61. In the example depicted in FIG. 13, the combo-cooler 10 has 3 heat exchangers 20, 20', 20". A bracket 180 is configured to have 3 manifolds that slide relative to the bracket 180 in the 74-75 directions, while constraining movement of the tanks relative to the bracket 80" in the 72-73 directions (see FIG. 5). To illustrate by comparison: the bracket 80 in FIG. 2 allows one manifold to slide relative to the bracket 80; the bracket 80' in FIG. 7 allows two manifolds to slide relative to the bracket 80'; and the bracket 180 in FIG. 13 allows three manifolds to slide relative to the bracket 180. In the comparison, sliding is allowed relative to the bracket 80, 80', 180 in the 74-75 directions and prevented in the 72-73 directions (see FIG. 5).

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Further, it is to be understood that the ranges provided herein include the stated range and any value or sub-range within the stated range. For example, an amount of thermal expansion and contraction of the tubes ranging from about 2 mm to about 7 mm should be interpreted to include not only the explicitly recited limits of 2 mm to 7 mm, but also to include individual amounts, such as 2.5 mm, 3 mm, etc., and sub-ranges, such as from about 2.3 mm to about 3.5 mm, etc. Furthermore, when "about" is utilized to describe a value, this is meant to encompass minor variations (±10% from the stated value (e.g., about 2 mm is 1.8 mm to 2.2 mm)).

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. A combo-cooler, comprising:

a plurality of heat exchangers having parallel tubes corresponding to each heat exchanger aligned in a tube plane;

a first end tank assembly disposed at a first end of the combo-cooler, the first end tank assembly including a columnar end tank separated by at least one baffle into a plurality of compartments wherein each compartment is in fluid communication with a respective hydraulically independent fluid circuit;

a second end tank assembly disposed at a second end of the combo-cooler opposite the first end wherein the second end tank assembly includes a plurality of manifolds substantially aligned in a column parallel to the first end tank assembly wherein serially adjacent manifolds in the plurality of manifolds are in slidable contact or separated by a respective gap to allow relative translation between the serially adjacent manifolds;

a plurality of banks of the parallel tubes brazed in fluid communication with a respective compartment of the first end tank assembly and a respective manifold of the second end tank assembly to connect the respective compartment and the respective manifold on the respective hydraulically independent fluid circuit to have a respective fluid flow therethrough; and a bracket in contact with at least two of the serially adjacent manifolds to prevent relative translation between the bracket and the at least two of the serially adjacent manifolds perpendicular to the tube plane and to allow relative translation between the at least two of the serially adjacent manifolds parallel to the tubes, wherein the bracket includes:

a first planar support surface having a first line of translation defined thereon, the first line parallel to the plurality of parallel tubes, the first planar support surface in slidable contact with a respective manifold to prevent relative motion between the bracket and the respective manifold in a first direction normal to the tube plane; and a second planar support surface opposite a first planar support surface and the second planar support surface having a second line of translation defined thereon, the second line parallel to the parallel tubes, the second planar support surface in slidable contact with a corresponding manifold to prevent relative motion between the bracket and the corresponding manifold in a second direction normal to the tube plane and opposite to the first direction.

2. The combo-cooler as defined in claim 1 wherein the bracket includes:

a plurality of first planar support surfaces each having a respective first line of translation defined thereon, each respective first line parallel to the plurality of parallel tubes, each of the first planar support surfaces in slidable contact with a respective manifold to prevent relative motion between the bracket and the respective manifold in a first direction normal to the tube plane; and a plurality of second planar support surfaces each opposite a respective first planar support surface and each second planar support surface having a respective second line of translation defined thereon, each respective second line parallel to the parallel tubes, each second planar support surface in slidable contact with a corresponding manifold to prevent relative motion between the bracket and the corresponding manifold in a second direction normal to the tube plane and opposite to the first direction.

3. The combo-cooler as defined in claim 1 wherein the bracket comprises a metal, a plastic, or combinations thereof.

4. The combo-cooler as defined in claim 1 wherein the bracket further includes a plurality of stop flanges each stop flange disposed in slidable contact with an end of a respective manifold to prevent relative motion between the bracket and the respective manifold orthogonal to a line defined parallel to the tubes and orthogonal to the first direction normal to the tube plane.

5. The combo-cooler as defined in claim 1 wherein the bracket includes a projection with a mounting point for attaching the combo-cooler to a vehicle.

6. The combo-cooler as defined in claim 5 wherein the mounting point defines an aperture for cooperation with a mounting fastener.

7. The combo-cooler as defined in claim 6 wherein the mounting point includes an attached or integrated fastener.

8. The combo-cooler as defined in claim 1 wherein:

the bracket includes a first leg projecting from a manifold-contacting portion of the bracket;

the bracket includes a second leg opposite the first leg, projecting from the manifold-contacting portion of the bracket;

the first leg and the second leg are each parallel to the tube plane; and the first leg and the second leg contact a core of the combo-cooler on opposed faces of the core of the combo cooler.

9. The combo-cooler as defined in claim 1 wherein:

the columnar end tank is a member of a plurality of columnar end tanks included in the first end tank assembly, the plurality of end tanks substantially aligned in an other column;

serially adjacent end tanks in the plurality of end tanks are in slidable contact or separated by a respective tank gap to allow relative translation between the serially adjacent end tanks;

a manifold of the second end tank assembly is separated by at least one septum into a plurality of enclosed volumes wherein, each enclosed volume is in fluid communication with a respective hydraulically independent fluid circuit; and an other bracket is in contact with at least two of the serially adjacent end tanks to prevent relative translation between the other bracket and the at least two of the serially adjacent end tanks perpendicular to the tube plane and to allow relative translation between the at least two adjacent end tanks parallel to the tubes.

10. The combo-cooler as defined in claim 9 wherein the other bracket comprises a metal, a plastic, or combinations thereof.

11. A combo-cooler, comprising:

a plurality of heat exchangers having parallel tubes corresponding to each heat exchanger aligned in a tube plane;

a first end tank assembly disposed at a first end of the combo-cooler, the first end tank assembly including a columnar end tank separated by at least one baffle into a plurality of compartments wherein each compartment is in fluid communication with a respective hydraulically independent fluid circuit;

a second end tank assembly disposed at a second end of the combo-cooler opposite the first end wherein the second end tank assembly includes a plurality of manifolds substantially aligned in a column parallel to the first end tank assembly wherein serially adjacent manifolds in the plurality of manifolds are in slidable contact or separated by a respective gap to allow relative translation between the serially adjacent manifolds;

a plurality of banks of the parallel tubes brazed in fluid communication with a respective compartment of the first end tank assembly and a respective manifold of the second end tank assembly to connect the respective compartment and the respective manifold on the respective hydraulically independent fluid circuit to have a respective fluid flow therethrough; and a bracket in contact with at least two of the serially adjacent manifolds to prevent relative translation between the bracket and the at least two of the serially adjacent manifolds perpendicular to the tube plane and to allow relative translation between the at least two of the serially adjacent manifolds parallel to the tubes, wherein:

the columnar end tank is a member of a plurality of columnar end tanks included in the first end tank assembly, the plurality of end tanks substantially aligned in an other column;

serially adjacent end tanks in the plurality of end tanks are in slidable contact or separated by a respective tank gap to allow relative translation between the serially adjacent end tanks;

a manifold of the second end tank assembly is separated by at least one septum into a plurality of enclosed volumes wherein, each enclosed volume is in fluid communication with a respective hydraulically independent fluid circuit;

an other bracket is in contact with at least two of the serially adjacent end tanks to prevent relative translation between the other bracket and the at least two of the serially adjacent end tanks perpendicular to the tube plane and to allow relative translation between the at least two adjacent end tanks parallel to the tubes; and the other bracket further includes an other plurality of other stop flanges each other stop flange disposed in slidable contact with an end of a respective end tank to prevent relative motion between the other bracket and the respective end tank orthogonal to an other line defined parallel to the tubes and orthogonal to the first direction normal to the tube plane.

12. The combo-cooler as defined in claim 9 wherein the other bracket includes an other projection with an other mounting point for attaching the combo-cooler to a vehicle.

13. The combo-cooler as defined in claim 12 wherein the other mounting point include a hole for cooperation with an other mounting fastener.

14. The combo-cooler as defined in claim 12 wherein the mounting point includes an attached or integrated other fastener.

* * * * *